US007703249B2

(12) United States Patent
Rachak

(10) Patent No.: US 7,703,249 B2
(45) Date of Patent: Apr. 27, 2010

(54) COVE MOLDING

(75) Inventor: Alexander L. Rachak, Wellington, CO (US)

(73) Assignee: The Shane Group, Hillsdale, MI (US)

( * ) Notice: Subject to any disclaimer, the term of this patent is extended or adjusted under 35 U.S.C. 154(b) by 46 days.

(21) Appl. No.: 11/695,814

(22) Filed: Apr. 3, 2007

(65) Prior Publication Data

US 2008/0245006 A1 Oct. 9, 2008

(51) Int. Cl.
*E04F 19/04* (2006.01)

(52) U.S. Cl. ..... 52/288.1; 52/60; 52/290

(58) Field of Classification Search ..... 52/287.1, 52/288.1, 58, 60, 61, 62, 716.1, 718.01, 717.05, 52/717.06, 717.03, 302.1, 302.3, 302.6, 716.01, 52/290, 220.7, 219, 220.5, 300; 439/209, 439/120, 216; D25/136
See application file for complete search history.

(56) References Cited

U.S. PATENT DOCUMENTS 462,164 A * 10/1891 Rockwell ..... 52/287.1
1,250,594 A * 12/1917 Knapp ..... 52/288.1
1,396,732 A * 11/1921 Cramer ..... 52/60
1,782,246 A * 11/1930 Schneider ..... 52/61
1,928,097 A * 9/1933 Fritch ..... 52/62
2,069,289 A * 2/1937 Swendsen et al. ..... 52/288.1
2,307,338 A * 1/1943 Sluyter et al. ..... 52/288.1
2,448,474 A * 8/1948 Stebbins ..... 52/59
2,856,871 A * 10/1958 Orth et al. ..... 52/60
2,984,049 A * 5/1961 Reddy ..... 52/60
2,994,905 A * 8/1961 Franker, Jr. ..... 52/273
3,201,909 A * 8/1965 Grun ..... 52/288.1
3,304,672 A * 2/1967 Bakke ..... 52/169.5
3,344,569 A * 10/1967 Cotten ..... 52/287.1
3,449,873 A * 6/1969 Zittler et al. ..... 52/127.12
3,464,177 A * 9/1969 Amato ..... 52/288.1
3,505,773 A * 4/1970 Thomas ..... 52/717.05
3,719,010 A * 3/1973 Hickman ..... 52/60
3,731,439 A * 5/1973 Hickman ..... 52/61
3,831,334 A * 8/1974 Rutkowski et al. ..... 52/288.1
3,942,295 A * 3/1976 Schacht ..... 52/287.1
3,979,860 A * 9/1976 Roth et al. ..... 52/61
4,008,549 A * 2/1977 Dobija ..... 52/287.1
4,052,828 A * 10/1977 Mancini et al. ..... 52/242
4,052,830 A * 10/1977 Smith ..... 52/288.1
4,319,528 A * 3/1982 Gutridge et al. ..... 105/397
4,423,284 A * 12/1983 Kaplan ..... 174/101
4,660,333 A * 4/1987 Romer ..... 52/302.3
4,800,689 A * 1/1989 Lane ..... 52/60
4,845,910 A * 7/1989 Hanson et al. ..... 52/287.1

(Continued)

FOREIGN PATENT DOCUMENTS

JP 02197669 A * 8/1990

(Continued)

*Primary Examiner*—Brian E Glessner
(74) *Attorney, Agent, or Firm*—Young Basile Hanlon & MacFarlane, PC

(57) ABSTRACT

A cove molding of tri-planar design comprising a floor mounted base leg, a wall mounted vertical leg and a sloping transition leg integrally connected between the two. A cap anchor is provided along with inside and outside corner transition pieces to provide a smooth flush continuum of cove molding in virtually any structural layout. The cove molding can also be used as a flashing member.

13 Claims, 5 Drawing Sheets

U.S. PATENT DOCUMENTS

| | | | | |
|---|---|---|---|---|
| 5,212,923 | A | 5/1993 | Pelosi et al. | 52/288 |
| 5,342,516 | A | 8/1994 | Rachak | 210/218 |
| 5,386,673 | A * | 2/1995 | Bellegarde | 52/182 |
| 5,444,954 | A * | 8/1995 | Anderson | 52/288.1 |
| 5,501,044 | A * | 3/1996 | Janesky | 52/169.5 |
| 5,553,431 | A | 9/1996 | Pelosi, Jr. et al. | 52/287.1 |
| 5,573,661 | A | 11/1996 | Rachak | 210/170 |
| 5,598,681 | A * | 2/1997 | DiGianni | 52/717.05 |
| 5,970,664 | A * | 10/1999 | Janesky | 52/107 |
| 6,122,872 | A * | 9/2000 | Sauter | 52/288.1 |
| 6,324,799 | B1 * | 12/2001 | Salvitti | 52/287.1 |
| 6,401,418 | B1 * | 6/2002 | Senn et al. | 52/506.01 |
| 6,421,971 | B1 * | 7/2002 | Gembala | 52/302.6 |
| 6,591,559 | B2 * | 7/2003 | Contreras et al. | 52/101 |
| 7,134,248 | B2 * | 11/2006 | Takagi et al. | 52/302.3 |
| 7,200,970 | B2 * | 4/2007 | Koenig et al. | 52/287.1 |
| 7,404,272 | B2 * | 7/2008 | Piche | 52/287.1 |
| 2005/0055936 | A1 | 3/2005 | Murphy, Jr. et al. | 52/506.01 |
| 2005/0102959 | A1 * | 5/2005 | Hintze | 52/716.1 |
| 2005/0166527 | A1 * | 8/2005 | Ernest et al. | 52/716.1 |
| 2006/0185295 | A1 * | 8/2006 | Gardner | 52/469 |
| 2008/0134602 | A1 * | 6/2008 | Schick | 52/287.1 |

FOREIGN PATENT DOCUMENTS

| | | |
|---|---|---|
| WO | WO 9306319 A1 * | 4/1993 |

* cited by examiner

COVE MOLDING

FIELD OF THE INVENTION

This invention relates to cove moldings of the type useable to create a transition between a horizontal surface and a vertical surface which intersect at a seam, as well as to a system comprising one or more length of such cove molding and combinations of inside and outside corner pieces which create functional and aesthetically pleasing transitions as the cove molding negotiates angular changes.

BACKGROUND OF THE INVENTION

The term "cove molding" as used herein, refers to an elongate body, or a continuum of such bodies, used to create a transition between a horizontal surface, such as a floor, and a vertical surface, such as a wall, which intersect at a seam. The word "molding" is not limited to fabrication of the body by any of the conventional molding techniques but may also include extrusion and even welding of sheet material. Nor is the term "molding" limited to articles of purely aesthetic application.

Cove moldings are commonly used to hide a floor to wall seam, to make such a seam easier to clean, to provide a seal or to achieve one or more of a variety of other goals. Cove moldings can be made of a variety of materials from wood to aluminum to fiber reinforced resin, can fit fully into the floor to wall seam or may simply cover the seam and provide a space behind itself for the routing of pipes, hoses or wires. Cove moldings can also be used as flashing devices in roof structures. All such uses are within the scope of the present invention.

SUMMARY OF THE INVENTION

The present invention provides, in one aspect, a cove molding which, as described above, is not necessarily fabricated by molding but may also be fabricated by extrusion or the assembly of various components. Whatever its construction, it is adapted to create a transition between a horizontal surface such as a floor and a vertical surface such as a wall which intersects the floor to create a seam. The cove molding of the present invention provides an elongate body of substantially uniform cross-section in rigid sheet like material having a flat base portion which is adapted to conformingly overlie the floor, a flat wall portion disposed above the flat base and at right angles thereto and adapted to lie against the vertical surface such as a wall, and a sloped transition section integrally joining the base and wall portions so as to create an essentially triangular volume between the interior surface of the cove and the seam or joint between the floor and wall against which it is mounted.

In one form hereinafter described in detail, the cove molding further comprises an anchor cap of suitable material such as aluminum and having an upper extremity which hooks over the top edge of the vertical cove molding leg and can be secured by driving an anchor fastener into the vertical wall. Various adhesives can also be used at strategic places to anchor the cove molding in place and provide seals.

According to another aspect of the invention, a system is provided whereby multiple lengths of cove molding can be assembled together to form a continuum of cove molding including inside corners, outside corners and splices.

Although the molding system of the present invention is most often used as a sanitary cove molding used in connection with the construction of public rest rooms and the like, it is subject to a variety of other uses including that of a roof flashing as hereinafter described.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE ILLUSTRATIVE EMBODIMENTS

Figure 1:
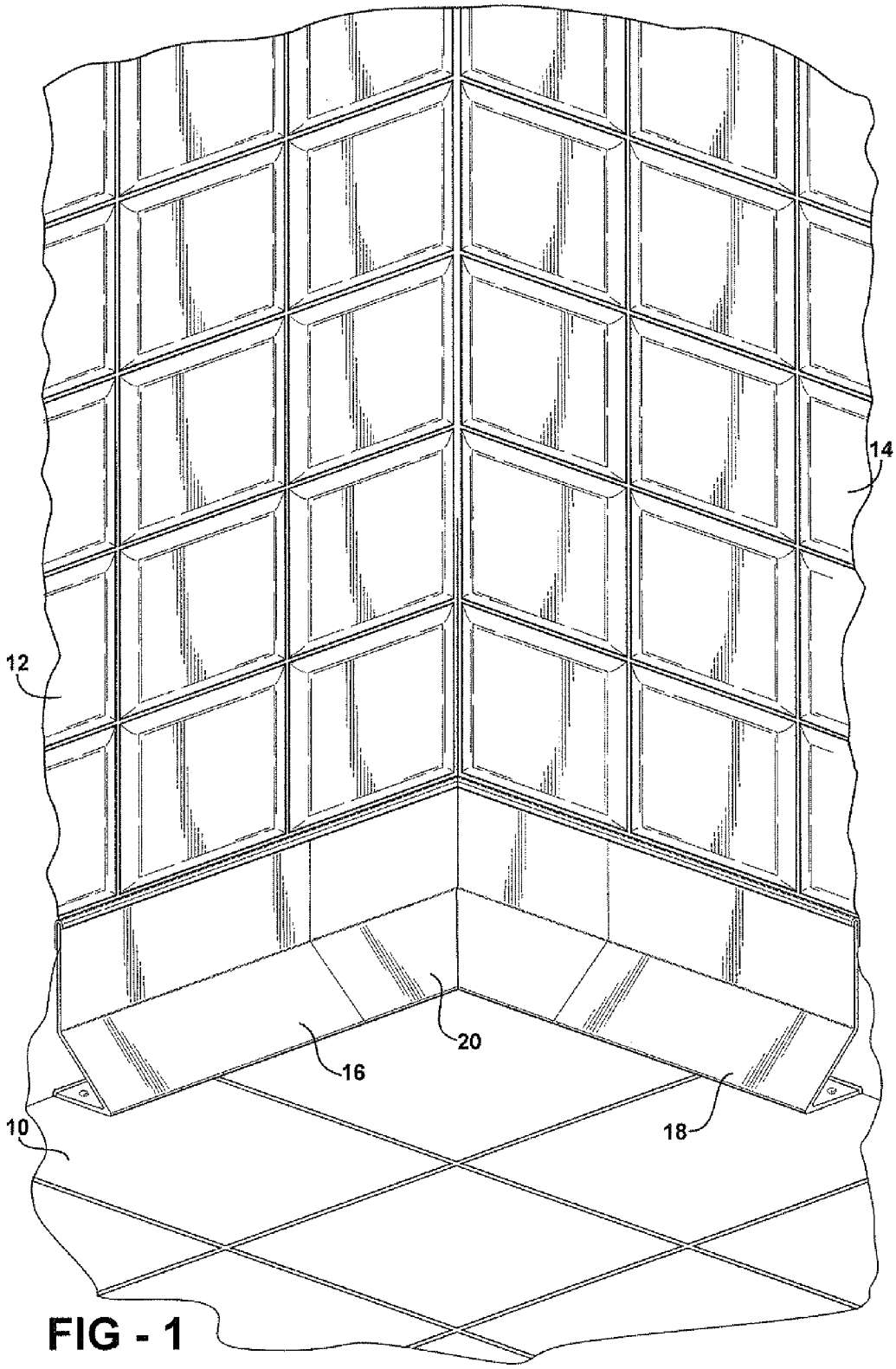
FIG. 1 is a perspective drawing of a portion of a room characterized by intersecting tiled walls and a tiled floor showing the location of a cove molding on the floor and extending into an inside corner below the tiled portion of said intersecting walls.

Referring to FIG. 1, there is shown a portion of a room having a tiled floor 10 bounded by right angle intersecting tiled walls 12 and 14. The seam between the floor 10 and the walls 12 and 14 is protected by a cove molding system comprising lengths of linear cove molding 16 and 18 joined together by an inside corner transition piece 20.

Figure 2:
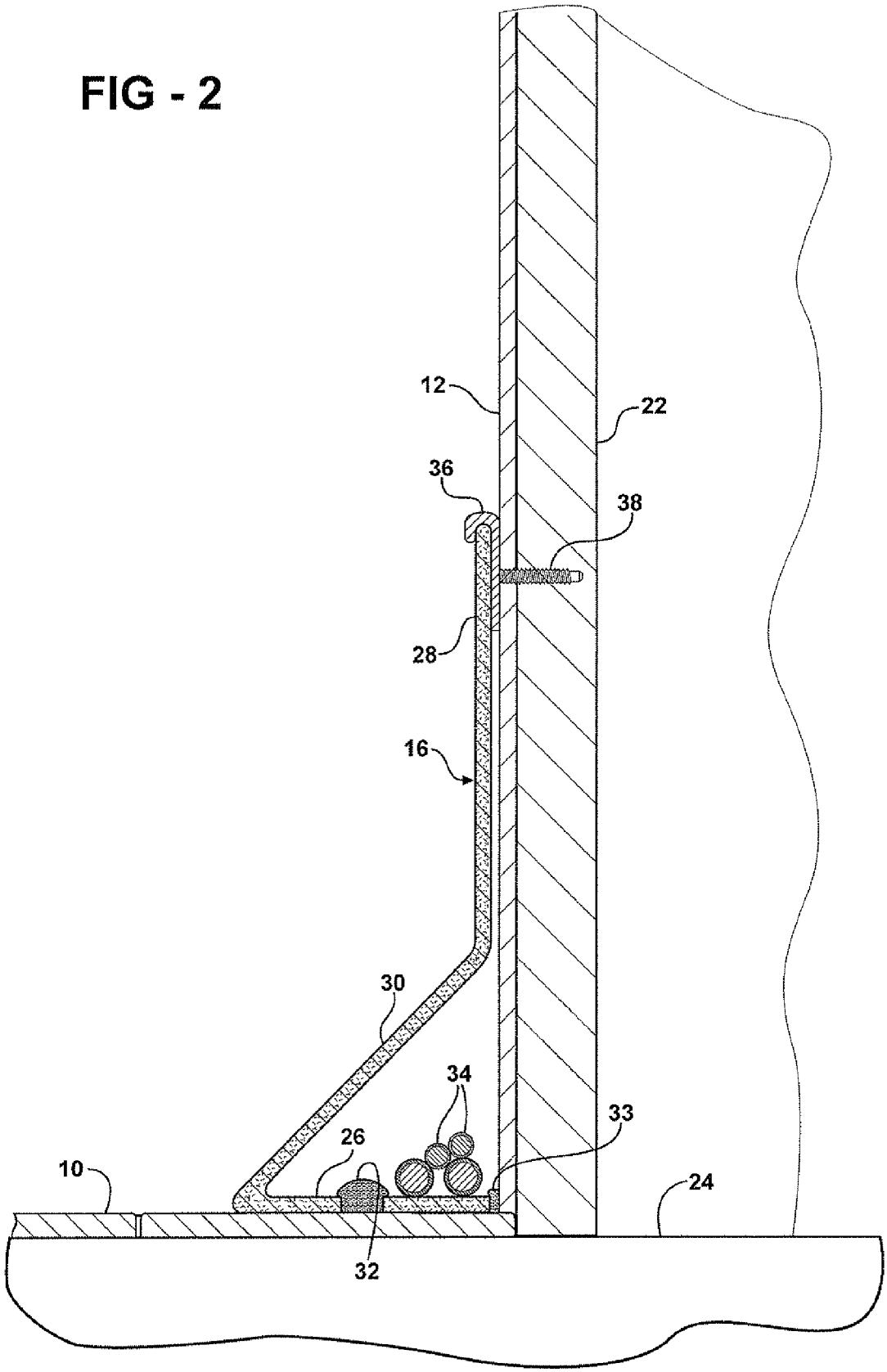
FIG. 2 is a cross-sectional view of a cove molding in accordance with the invention used not only as a cove molding but also as a location for the protective routing of wires and cables.

Referring to FIG. 2, the cove molding 16 as shown in cross-section will protect and provide a transition between the outside surface of the wall 12 and the floor 10. The tiled wall 12 is shown to be mounted on conventional gypsum board or plywood 22 whereas the tiled floor 10 is laid on a concrete base 24. These materials are given purely by way of example. The cove molding 16 comprises a planar base leg 26 which is adapted to conformingly overlie the floor 10, a vertical wall portion 28 disposed above the base leg 26 and at right angles thereto so as to overlie the tiled wall 12, and the sloped portion 30 which is integral with the base 26 and wall portion 28 and which defines an acute internal angle with the base leg 26 and an obtuse included angle with the wall portion 28.

The molding 16 can be made of a number of materials including white gel coated resin, aluminum, fiber reinforced resin and numerous other materials. It is preferably extruded so as to be of uniform cross-section over its entire length.

A anchor cap 36 made of aluminum is hooked over the top extremity of the wall portion 28 and carries a threaded anchor 38 which is driven into the wall board 22 to secure the molding 16 in place. Apertures are preferably formed in the base leg 26 at regular intervals of from 12" to 18" so as to provide a location for an adhesive caulking 32. Additional caulking 33 may be provided at the rear of the base leg where it abuts the wall 12. The caulking bead 33 is preferably continuous.

As shown in FIG. 2 the shape and configuration of the cove molding 16 is such as to define a volume of triangular cross-section which readily accommodates and protects wires and cables 34 or other elongate objects such as water and gas lines.

Although these dimensions are given by way of example, the cove moldings 16 may be about 4" tall, the wall portion 28 being about 2½" in height, the base leg 26 being about 1½" to 2" in depth. The thickness of the extruded material is approximately 0.93". Where the cove molding 16 is intended for use as a sanitary molding, it is preferably made of a corrosion resistant polyester resin with a 20 ml white gel coat finish. It may also be made of aluminum with a powder coated finish. Other finishes and materials will be apparent to those skilled in the art.

Figure 3:
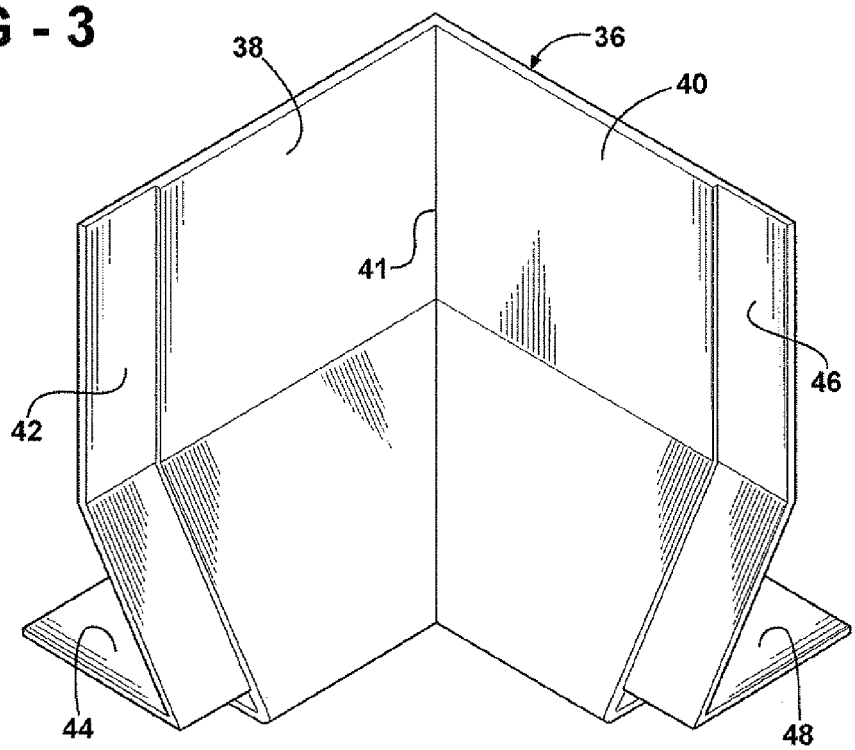
FIG. 3 is a perspective drawing of a inside corner piece for use in joining lengths of cove molding at an inside corner.

Referring now to FIG. 3, an inside corner cove molding piece 36 is shown to comprise intersecting tri-planar sections 38 and 40 which meet orthogally to form a center seam 41. Each of the tri-planar sections 38 and 40 is of essentially the same contour and size as that of the cove molding 16. However, the left edge of tri-planar section 38 is recessed as shown at 42 by a depth equal to the thickness of the cove molding 16. In addition, the base leg 44 of the recessed band 42 is raised so that the base leg 26 of the cove molding 16 can fit under the base leg 44 when the cove molding 16 is spliced from the left side of the corner piece to the inside corner piece 36. While a 90° corner will be most common, other angles can be accommodated by suitable variation in the corner piece. It can also leave no angle at all, and be used to splice two moldings together.

Similarly, the right edge of tri-planar section 40 is recessed at 46 and the base leg 48 is raised off of the floor to permit a properly trimmed edge of the cove molding 16 to slide into place overlapping the recessed portion 46 and fitting under the base leg 48 as a smooth continuum is provided and the seams may be adhesively caulked to keep out moisture.

Figure 4:
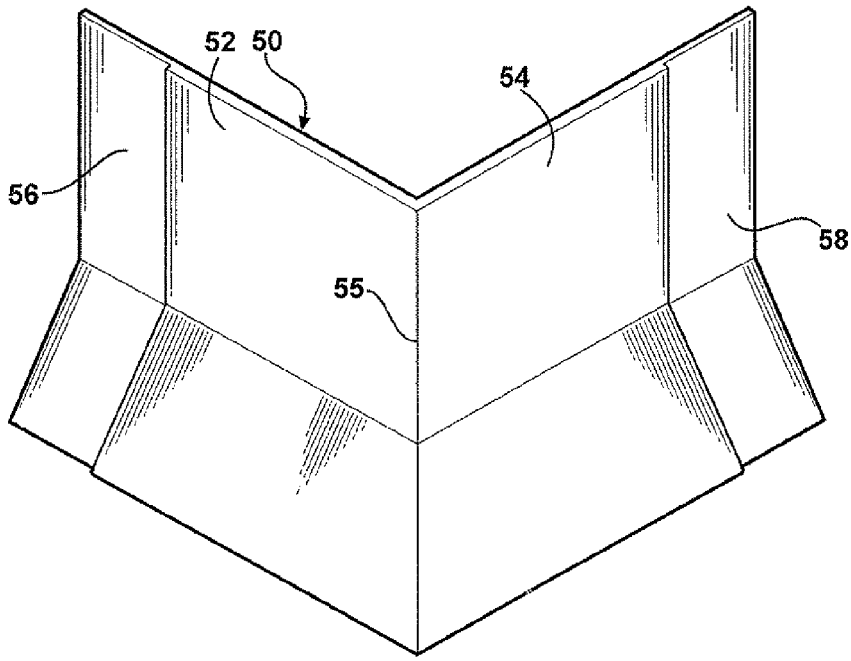
FIG. 4 is a perspective drawing of the transition piece used to splice or join lengths of cove molding at an outside corner.

FIG. 4 shows an outside corner piece 50 with orthogonal tri-planar sections 52 and 54 forming an outside corner seam 55. The tri-planar section 52 has a recessed portion 56 which permits a properly trimmed cove molding to fit over it flush with the outside surfaces of the tri-planar portion 52. Similarly the tri-planar portion 54 is recessed at 58 such that the trimmed edge of an adjacent cove molding 16 can fit thereover and be flushed with the outside surfaces of the tri-planar of portion 54.

Figure 5:
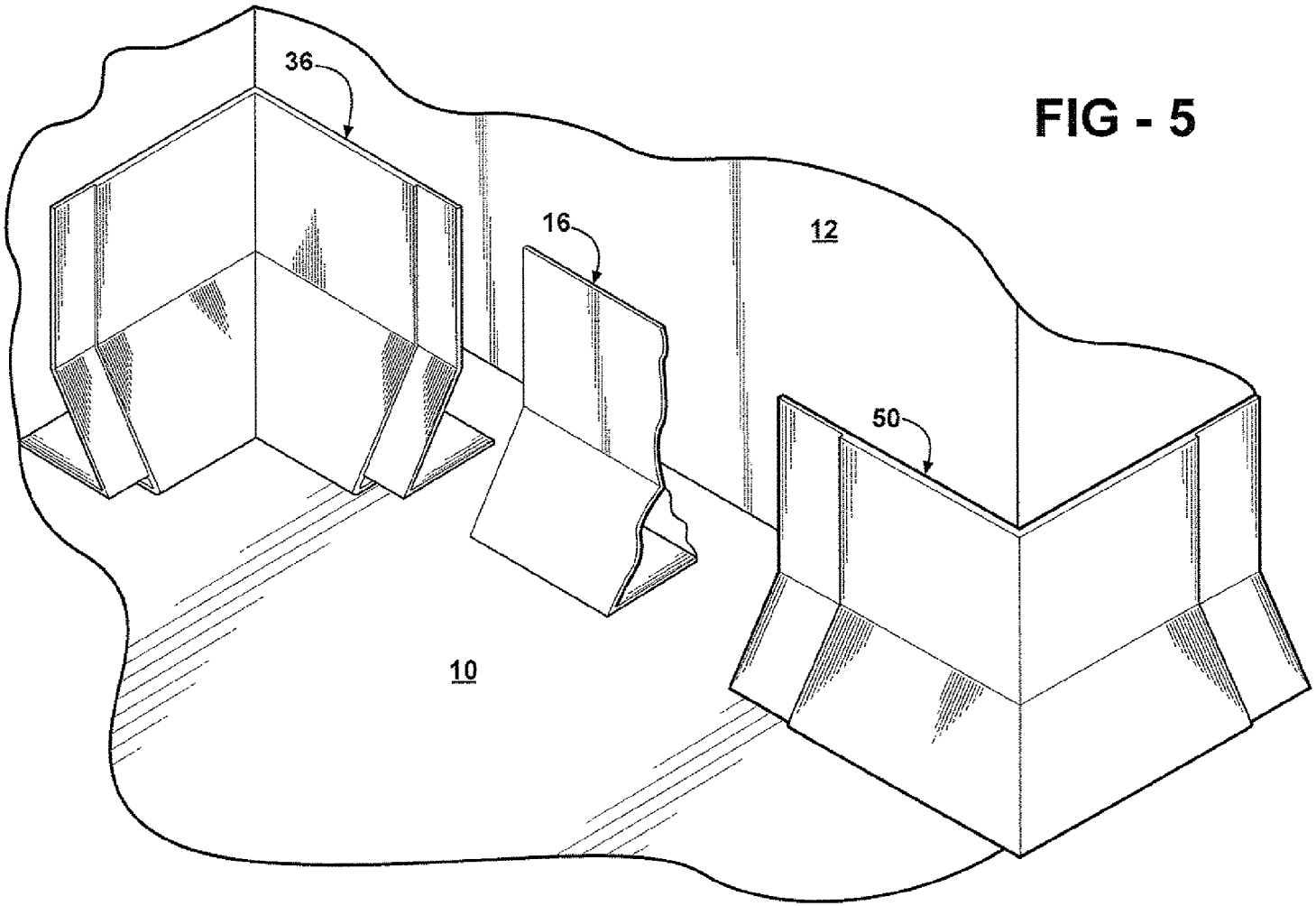
FIG. 5 is a perspective drawing of the system comprising an abbreviated length of cove molding and the combination of both inside and outside transition pieces.

FIG. 5 illustrates a system comprising a length of cove molding 16 disposed on the floor 10 and adjacent the wall 12 and used in combination with an inside corner piece 36 and an outside corner piece 50. It will be apparent to those skilled in the art that the cove molding 16 overlaps each of the right and left edges respectively of the inside and outside corner pieces 36 and 50 to provide a smooth flush outside surface. Although no anchor cap 36 is shown in the drawing of FIG. 5, it is to be understood that a length of extruded anchor cap properly mitered and cut to size can be fit over the tops of the cove molding 16 and corner pieces 36 and 50 to provide a smooth continuous appearance. As stated above, the angles may be other than 90°.

Figure 6:
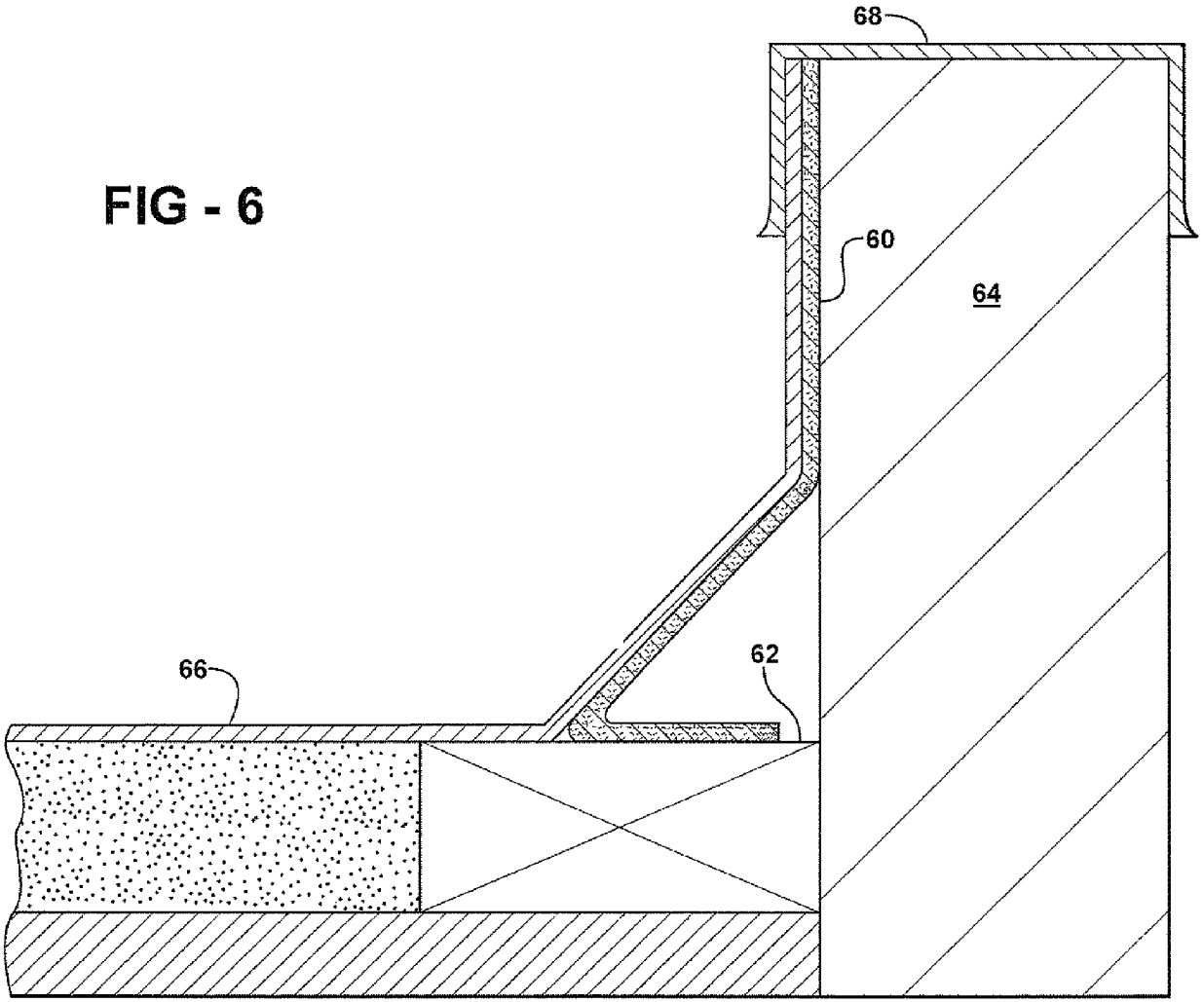
FIG. 6 is a cross-sectional view of a cove molding used as a flashing piece over the seam between an insulated roof and a wall or chimney.

FIG. 6 shows an alternative use of a cove molding 60 having essentially the same configuration as the cove molding 16 but used in this case as a flashing between an insulated roof 62 and an outside structural wall 64 which may be masonry or wood or concrete. A roof membrane 66 overlies the cove molding 60 and metal flashing 68 trims the top of the structural wall 64.

It will be apparent that a straight splice can be constructed essentially identical with either of the corner pieces 36 and 50 but without an orthogonal meeting of two tri-planar portions; i.e., a simple straight, tri-planar section is provided with left and right recessed sections with raised horizontal feet to allow the trimmed edges of respective cove moldings to telescopically slide into place over the recessed bands.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A cove molding of the type adapted to create a transition between a floor and a wall joined at a seam comprising:

an elongate and uniform body of substantially rigid sheet material having a flat base portion adapted to overlie the floor, a wall portion disposed above and at a substantially right angle to the base portion and adapted to lie against the wall intercepting said floor at the seam, and a sloped portion integrally joining a front extremity of the base portion to a lower extremity of the wall portion, said base portion underlying said sloped portion so as to define an acute angle with the sloped portion, said sloped portion forming an obtuse angle with the wall portion and a volume triangular in section between the molding and said floor and wall;

an inverted J-shaped anchor cap of rigid material extending in hooked fashion over a top edge of the wall portion in contact with a continuous surface of the wall portion including part of a front side and the top edge of the wall portion and extending down a rear wall-facing side of the wall portion to lay flushly against the wall; and an anchor engaged with the anchor cap below the top edge of the wall portion for securing the anchor cap to the wall.

2. The cove molding of claim 1 wherein the molding has an overall height of about 4", the height of the wall portion is about 2½", the length of the sloping portion is about 2" and the depth of the base portion is about 1½".

3. The cove molding of claim 1 wherein the material of construction is a corrosion resistant polyester resin with a white gel coat finish.

4. The cove base of claim 1 wherein the anchor cap is made of aluminum.

5. The cove molding of claim 1 further including an inside corner section adapted to join two lengths of said cove molding at an inside coiner and comprising:

a first side tri-planar portion at least approximating the shape of the cove molding;

a second side tri-planar portion integrally joined to the first side tri-planar portion at an angle thereto to form a seam; and each of said side tri-planar portions having at least one side edge with a recessed width which can be conformingly overlapped by the wall and floor portions of said cove moldings.

6. The cove molding combination defined by claim 5 wherein each of said side tri-planar portions includes an integral base leg which is disposed in spaced parallel relationship to the floor when the inside corner section is placed on said-floor such that the base portion of a length of cove molding can fit into a space between the base leg and the floor and can underlie the base leg when joined thereto.

7. The cove molding of claim 1 further including an outside contour section adapted to join two lengths of said cove molding at an outside corner and comprising:

a first tri-planar portion following the shape of the cove molding;

a second tri-planar portion integrally joined to the first tri-planar portion at an angle thereto to form an outside seam;

each of said tri-planar portions having at least one side edge with a recessed width which can be conformingly overlapped on the wall portion and slope portion of an adjacent cave molding.

8. In combination:

a cove molding of the type adapted to create a transition between a horizontal surface and a vertical surface and including an elongate body of substantially rigid sheet material formed into a tri-planar configuration and including a flat base portion adapted to overlie the horizontal surface and defining at least one aperture extending from a horizontal surface-facing side of the base portion, a flat wall portion disposed above and at a substantially right angle to the base portion and adapted to lie against said vertical surface, and a sloped portion integrally joining a front extremity of the base portion to a lower extremity of the wall portion such that the base portion directly underlies the sloped portion;

an inside corner transition piece of tri-planar con figuration conforming essentially in cross section to the cross-section of said cove molding and having recessed opposite edges adapted to be conformingly overlapped by said cove molding;

an outside transition piece of tri-planar configuration having a cross-section which conforms with the cross-section of the cove molding and having at least one outside edge which is recessed so as to be conformingly overlapped by an edge of said cove molding; and an anchor cat having a first vertically extending side wall, a second vertically extending side wall spaced a thickness of the sheet material from and generally parallel with the first side wall, and a top portion extending between the first and second side walls, wherein the anchor cap is over a top edge of the wall portion such that the entirety of a contact area between the first side wall of the anchor cap and the front side of the wall portion extends vertically.

9. The system described in claim 8 wherein all of said cove molding and transit ion pieces are fabricated of a reinforced organic resin.

10. The cove molding of claim 1 wherein a floor-facing side of the base portion defines a plurality of apertures spaced along a length of the base portion.

11. A cove molding of the type adapted to create a transition between a floor and a wall joined at a seam comprising:

an elongate and uniform body of substantially rigid sheet material formed into a tri-planar configuration and having a flat base portion adapted to overlie the floor, having a wall portion disposed above and at a substantially right angle to the base portion and adapted to lie against the wall, and having a connecting portion extending between a lower extremity of the wall portion and a front extremity of the base portion; and an anchor cap of rigid material having a head portion hooked over a top edge of the cove molding wall portion and in contact with a continuous surface of the wall portion including the top edge of the wall portion and a portion of a front side of the wall portion such that a contact area between the anchor cap and the top edge of the cove molding has a length substantially equal to a thickness of the sheet material and an entirety of a contact area between the front side of the wall portion and tile anchor cap extends vertically, the anchor cap having a plate portion extending clown the backside of the wall portion and between the wall portion and the wall.

12. The cove molding of claim 11, wherein the anchor cap is spaced vertically above the connecting portion.

13. The cove molding of claim 11, wherein the base portion defines a plurality of evenly spaced apertures extending from a floor-facing side of the base portion.

* * * * *